US005851010A

United States Patent [19]

Feinberg

[11] Patent Number: 5,851,010

[45] Date of Patent: Dec. 22, 1998

[54] METHOD OF PLAYING A GAME

[76] Inventor: Isadore Feinberg, 1717 St. Georges Rd., Dresher, Pa. 19025

[21] Appl. No.: 980,880

[22] Filed: Nov. 25, 1997

[51] Int. Cl.[6] ..... A63F 1/00

[52] U.S. Cl. ..... 273/274; 273/138.1

[58] Field of Search ..... 273/274, 269, 273/138.1, 139, 146

[56] References Cited

U.S. PATENT DOCUMENTS

| | | | |
|---|---|---|---|
| 3,533,629 | 10/1970 | Raven . | |
| 3,873,092 | 3/1975 | Fagan . | |
| 4,033,588 | 7/1977 | Watts . | |
| 4,339,798 | 7/1982 | Hedges et al. . | |
| 4,346,900 | 8/1982 | Lamlee . | |
| 4,756,531 | 7/1988 | DiRe et al. . | |
| 4,836,553 | 6/1989 | Suttle et al. . | |
| 4,902,019 | 2/1990 | Berman . | |
| 5,178,395 | 1/1993 | Lovell . | |
| 5,192,076 | 3/1993 | Komori . | |
| 5,273,281 | 12/1993 | Lovell . | |
| 5,308,081 | 5/1994 | Bartle . | |
| 5,340,119 | 8/1994 | Goldfarb . | |
| 5,350,175 | 9/1994 | DiLullo et al. . | |
| 5,401,024 | 3/1995 | Simunek . | |
| 5,413,351 | 5/1995 | Franklin . | |
| 5,544,893 | 8/1996 | Jones et al. . | |
| 5,673,917 | 10/1997 | Vancura | 273/274 |
| 5,718,431 | 2/1998 | Ornstein | 273/274 |

*Primary Examiner*—William M. Pierce
*Attorney, Agent, or Firm*—Panitch Schwarze Jacobs & Nadel, P.C.

[57] ABSTRACT

A method of playing a game and a tracking device used in connection with the game are provided. The method includes (a) using a gaming device for generating one of a first outcome and a second outcome for gaming decisions; (b) selling a chance to a player for a price s for playing a number of decisions n of the gaming device, where n is greater than 1; (c) the player selecting and wagering on one of the first and second outcomes separately for each of the number of decisions n; (d) generating a series of n decisions with the gaming device from one of the first and second outcomes; (e) tracking a correct number of decisions m made by the player out of the number of decisions n purchased by the player; and (f) paying the player having a predetermined correct number of decisions an amount based on a binomial distribution.

15 Claims, 1 Drawing Sheet

METHOD OF PLAYING A GAME

BACKGROUND OF THE INVENTION

The present invention relates to a new game, and more particularly, to a casino game using a gaming device for generating one of a first outcome and a second outcome for each wagering decision in which a player wagers on a series of decisions and is paid off based on a predetermined correct number of decisions in the series of decisions.

During the past fifty years, no new table games have been introduced into casinos which have competed successfully with the established games such as blackjack, craps, roulette or baccarat. However, the known table games all favor the casino to win on each play, and to the extent that better odds can be obtained by an intelligent player, the odds of winning are still overwhelmingly in favor of the casino. Additionally, novice players are quickly fleeced of their money without receiving any entertainment value, often resulting in a lack of repeat customers at casinos.

Some attempts have been made to provide more excitement and to obtain frequent, loyal, repeat customers in casinos by providing gaming devices which increase the players's odds of winning. However, the only known device is in the form of a slot-type machine, which has not been adopted in any consequential numbers.

It would be desirable to provide a game which provides the player with an even chance of making a winning decision on each play, or possibly a better than even chance, in order to provide player excitement. It would also be desirable to provide the possibility of obtaining a large value jackpot for a relatively small opportunity cost in which the player is able to make a decision regarding a number of gaming plays using a relatively simple gaming format, which provides the opportunity to wager on a series of plays at a discounted rate. It would also be desirable to provide the opportunity for players at existing table games to make side wagers for a relatively small opportunity cost which would allow them the possibility of winning large jackpots based on a correct number of decisions, as well as eliminating non-play events, such as the first two rounds of cards being dealt in blackjack.

SUMMARY OF THE INVENTION

Briefly stated, the present invention provides a method of playing a game. The method comprises:

(a) using a gaming device for generating one of a first outcome and a second outcome for gaming decisions;

(b) selling a chance to a player for a price s for playing a number of decisions n of the gaming device, where n is greater than 1;

(c) the player selecting and wagering on one of the first and second outcomes separately for each of the number of decisions n;

(d) generating a series of n decisions with the gaming device from one of the first and second outcomes;

(e) tracking a correct number of decisions m made by the player out of the number of decisions n purchased by the player; and (f) paying the player having a predetermined correct number of decisions an amount based on a binomial distribution.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. The drawings are for the purpose of illustrating the present invention which is not limited to the devices and instrumentalities shown.

In the drawings.

DETAILED DESCRIPTION OF THE INVENTION

Figure 1:
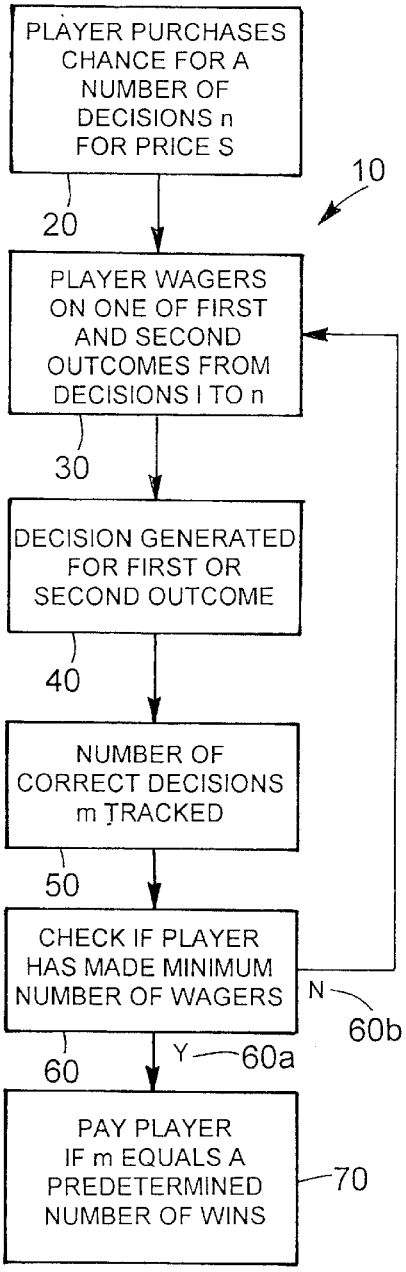
FIG. 1 is a block diagram of the steps used in playing a game in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the tracking tray used with game in accordance with the present invention and designated parts thereof. The terminology includes the words above specifically mentioned, derivatives thereof and words of similar import.

Referring now to FIG. 1, a block diagram for a preferred method of playing a game 10 in accordance with the present invention is shown. The method for playing the game involves using a gaming device for generating one of a first outcome and a second outcome for gaming decisions. The gaming device can be cards, dice, a random numbered generator or any other desired device which generates events which can be categorized or divided into first and second outcomes. For example, if one or two dice are used, the first outcome can be odd numbers and the second outcome can be even numbers. In this case, there is an even probability of getting an odd number or an even number. Similarly, a deck of cards can be broken into odd and even numbers by designating the jack and king odd. The ace can be used, in which case odd cards would outnumber even 7 to 6 or can be designated a no play card. Alternatively, a deck of cards can be used with the first outcome being represented by red cards, and the second outcome being represented by black cards, or any other desired combination. A coin can also be used in which the first outcome would be a first side of the coin and the second outcome would be the second side of the coin.

While in the preferred embodiment, the probability of either the first outcome or the second outcome occurring is 0.500, this can be altered to provide greater odds of the first outcome and/or the second outcome occurring. For example, using two dice, the first outcome can be represented as seven and over, and the second outcome can be represented as seven and under, providing a probability of greater than 0.500 for the occurrence of either the first outcome or the second outcome.

As shown in block 20 of FIG. 1, the method comprises selling a chance to a player for a price s for playing a number of decisions n of the gaming device, where n is greater than 1. In the preferred embodiment, the player receives a marker (not shown in FIG. 1) for each of the number of decisions n. Preferably, each marker includes first indicia representing the first outcome on a first side and second indicia representing a second outcome on a second side. The markers preferably have a non-negotiable wagering value, such as $5. In one preferred embodiment, the price of the n markers are discounted up to approximately 90 percent of the non-negotiable wagering value when the markers are sold to the player.

For the purposes of the present game, it is important to understand that the markers merely represent an opportunity to wager on one of the first and second outcomes for gaming decisions, and the marker has a positive value when a player wins a gaming decision and a negative value when a player looses. The initial price s is a fixed cost for entering the game of n decision. Once the initial opportunity cost s is paid, even if a player loses more of the n decisions than the player wins, the total result can not be less than zero (i.e., once the opportunity cost is paid, the player does not pay more if he loses more than he wins).

As shown in block 30, the player selects and wagers on one of the first and second outcomes separately for each of the number of decisions from 1 to n. The player can only wager one non-negotiable chip (representing a single decision) at a time. In a-preferred embodiment, the player selects one of the first and second outcomes for each of the n decisions by placing a marker for each decision with the side with the indicia representing the selected outcome for facing up so that the dealer can identify the player selected outcome. Alternatively, separate wagering areas are provided for the first outcome or the second outcome, and the player places a single marker into the selected wagering area to select the outcome for each gaming decision. This would eliminate the need to have separate indicia on each side of the marker. For example, there can be a designated wagering area on a game board for red and black and/or odd and even, depending upon the game.

As shown in block 40, a decision is generated using the gaming device which can produce the first or second outcome. Generating a decision can be accomplished through rolling the dice, running a random number generator or the dealer dealing a card or drawing a card from a shoe. Those skilled in the art will recognize from the present disclosure that any other type of gaming device can be also used, such as a gaming wheel, a roulette wheel, or a video or automated gaming machine configured to allow selecting one of the first and second outcomes prior to generating an outcome for each of the n decisions.

As shown in block 50, the number of correct decisions m made by the player out of the number of decisions n purchased by the player is tracked. Tracking can be accomplished in a number of ways, for example, by keeping separate stacks of markers for winning decisions and losing decisions. Additionally, automated gaming machines can automatically track a correct number of player wins and losses.

As shown in block 60, preferably the dealer checks if the player has made a minimum number of wagers, or if the player has a predetermined correct number of decisions. Preferably, this is set at a number greater than n/2, and more preferably, the player is required to wager on all n decisions prior to receiving a pay off if the player has the predetermined correct number of decisions required to win. The amount paid to the player is based on a binomial distribution, and may be less than a true odds payoff, depending on the pay table selected by the casino and the minimum number of wins m required to win. However, the payoff can also be greater than a true odds payoff, depending upon the minimum number of correct decisions m required for a player to win.

A binomial distribution gives a probability for obtaining a specified number of successes in a finite set of independent trials in which the probability of success remains the same from trial to trial. By basing the payoff to the player upon a binomial distribution and paying off only players having a predetermined correct number of decisions m, which is preferably greater than n/2, a casino or house will pay out less money than is taken in by paying less than true odds payoffs while still providing the opportunity for winning large jackpots at a relatively modest initial cost.

It will be recognized by those skilled in the art from the present disclosure that markers need not be used for the present game. For example, in an automated game the player selection for each decision can be entered, the correct number of decisions along with the number of games tracked, and the payoff made.

Figure 2:
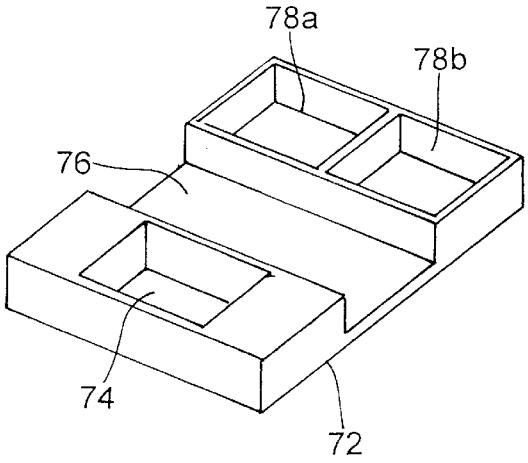
FIG. 2 is a perspective view of a preferred gaming tray for use in tracking a correct number of decisions in the game in accordance with the present invention.

As shown in FIG. 2, for table games in accordance with the present invention the player is preferably provided with a gaming tray 72 having a storage area 74 for holding markers. The gaming tray 72 also includes a wagering area 76 for wagering on one of the first and second outcomes and a tracking area 78*a,* 78*b* for tracking wins and losses. Preferably, the player removes one of the markers (not shown) from the storage area 74 and places the marker in the waging area 76 in order to select and wager on one of the first and second outcomes for each decision prior to the gaming device generating one of the first and second outcomes. The wagering area 76 is preferably split into two separate compartments to provide an easier visual indication of which outcome is being wagered upon.

After the gaming device is used to generate one of the first and second outcomes, the marker is moved by the dealer from the wagering area 76 to the tracking area 78*a* if the player wins, or the tracking area 78*b* if the player looses. Using this gaming tray 72, a dealer can easily determine the status of a player's game by seeing how many winning decisions the player has made by the number of markers in tracking area 78*a,* how many losing decisions the player has made by seeing the number of markers in the tracking area 78*b,* and how many decisions the player has remaining by seeing the number of markers in the storage area 74.

In a preferred game, at least one of a consecutive number of wins and a consecutive number of losses by the player is tracked. The player is payed a jackpot based on the player having at least one of a predetermined number of consecutive wins and a predetermined number of consecutive losses. Consecutive wins and losses can be tracked by placing a separator in the tracking area to identify consecutive number of wins and/or losses. A jackpot can be paid for either a minimum number of consecutive wins or a minimum number of consecutive losses or both, affording the player an opportunity to win, even if the player is a "loser." This allows gamblers who believe they are on a bad luck streak to at least have an opportunity to still win a jackpot, which may encourage continued play.

The jackpot may also beta progressive jackpot which is paid for at least one of consecutive win streaks or consecutive loss streaks. In order to add additional excitement to the game, the predetermined number of consecutive wins and/or the predetermined number of consecutive losses needed to win the jackpot can initially be set at n. After an occurrence of one of a predetermined number of plays and/or a predetermined dollar amount of player losses without the jackpot being won, the value of the predetermined number of wins required to win the jackpot can be reduced to n−1. The value can be further reduced at incremental stages until the jackpot is won, if desired.

Casinos can also offer a guaranteed periodic jackpot payoff with the odds for winning such a payoff being substantially less than the odds typical for other games in order to obtain the large payoff.

In order to add additional interest and attract additional players, a jackpot can be paid to a player based on the player having a predetermined number of consecutive wins, a predetermined number of consecutive losses, a predetermined number of consecutive wins with an interruption and/or a predetermined number of consecutive losses with an interruption. This would allow a player in a game, for example, having n=11 decision to still win a reduced jackpot if they have a predetermined number of consecutive wins or losses, for example, ten with a single interruption.

The present game can be played as a stand alone game, or can also be played concurrently with another game having an outcome generating device, such as blackjack or craps. The outcome generating device for the other game is used as the gaming device for the present game, and the player selects one of the first and second outcomes for each decision as a side bed. This provides action for the player on each play which could otherwise be a non-decision play. For example, in blackjack, at least the first and second cards dealt to the player can be used as the outcome for gaming decisions for the present game. Each hand dealt to a player would provide at least two decisions, with the first and second outcomes being red or black, or any other designated split, such as high cards or low cards or odd and even, as described above. The player selects one of red and black for each of the gaming decisions as a side bet in order to have some play on each round of cards dealt. The side bet can be made on each card dealt, or only on predetermined cards which are dealt to each player, for example, each player only betting on the cards dealt to the player and the player not being able to bet on cards dealt to the other players in the same game. Alternatively, each card dealt face up can be used as a gaming decision, if desired.

In craps, each roll of the dice can be used as an outcome for a gaming decision, with the first and second outcomes being preferably one of odd and even or 7 and over and 7 and under. The player selects a selected one of odd and even or 7 and over and 7 and under for each of the gaming decisions as a side bet. It will be recognized by those skilled in the art from the present disclosure that other combinations can be used for dice or cards, or any other type of gaming device which is used. Preferably, the selection is made such that the gaming device which provides for a probability of winning of 0.500. It will be similarly recognized that the probability for winning need not be 0.500, and can be higher or lower, as long as the total amount paid off per player is on average less than a true odds payoff based on a binomial distribution.

In one preferred game, the number of decisions purchased by the player is n=11 and the price is s=$7 or a multiple z thereof. The player wagers on each of the gaming decisions n and the value of m is tracked. Preferably, the player is paid off based on the following table:

| value of m | payoff amount |
|---|---|
| 6 | $3z |
| 7 | $7z |
| 8 | $11z |

-continued

| value of m | payoff amount |
|---|---|
| 9 | $50z |
| 10 | $100z |
| 11 | $1000z |

Using a binomial distribution formula for winners, the expected number of winners and the cumulative number of winners out of 100 players for each of the 11 decisions is shown below.

| Number of Wins | Expected Number of Winners Per 100 Players | Cumulative Number of Winners Out of 100 Players |
|---|---|---|
| 0 | 0.04882812 | 0.04882812 |
| 1 | 0.54 | 0.586 |
| 2 | 2.69 | 3.27 |
| 3 | 8.06 | 11.33 |
| 4 | 16.11 | 27.44 |
| 5 | 22.56 | 50.00 |
| 6 | 22.56 | 72.56 |
| 7 | 16.11 | 88.67 |
| 8 | 8.06 | 97.73 |
| 9 | 2.69 | 99.41 |
| 10 | 0.54 | 99.95117188 |
| 11 | 0.04882812 | 100.00 |

As can seen based on the distribution and the payout, gaming organizations can obtain a positive win revenue by offering wagers that have a zero win percentage, or even a negative win percentage for the casino by paying on average less than a true odds payoff. However, players can obtain greater than a true odds payoff and casinos can still profit with a negative win percentage, if the number of wins m required before a player receives any payoff is raised. This allows the casino to discount the price s for the number of decisions n purchased for a given game. If 100 players purchased a chance for n=11 decisions at a cost of s=$7, the handle for 100 players is $7×100 or $700. The standard pay table provided would offer a prize of $7 or break even for 7 wins or more with a lesser prize for 6 wins. This also provides the opportunity for a large jackpot for players have 10 or 11 wins, although the odds of winning the large jackpot are small.

By using the binomial distribution formula for winners, gaming organizations can advertise very accurate average information to encourage new players to play. It will be recognized by those skilled in the art from the present disclosure that s can be greater or smaller depending upon the payoff table for the predetermined number of wins, and that the above example is for illustrative purposes only and is not limited to the specific payoff table shown, the specific number of decisions or the cost for a chance for playing the n number of decisions. Payoff tables can be adjusted for a variety of payoffs, especially if the expected number of winners are predictable.

In another example, n=40 decisions and s=$20, with each of the decisions n being represented by a non-negotiable marker having a value of $5. Based on a binomial distribution, the following payoff can be made to players obtaining 20 or more wins.

| Number of Wins | Expected Number of Winners Per 100 Players | Win Per Player S | Total Payoffs S |
|---|---|---|---|
| 20 | 12.54 | 5.00 | 62.70 |
| 21 | 11.94 | 15.25 | 182.09 |
| 22 | 10.31 | 25.50 | 262.91 |
| 23 | 8.07 | 35.75 | 288.50 |
| 24 | 5.72 | 46.00 | 263.12 |
| 25 | 3.66 | 56.25 | 205.88 |
| 26 | 2.11 | 66.50 | 140.32 |
| 27 | 1.09 | 76.75 | 83.66 |
| 28 | 0.51 | 87.00 | 44.37 |
| 29 | 0.21 | 97.25 | 20.42 |
| 30 | 0.0760 | 107.50 | 8.17 |
| 31 | 0.0249 | 117.75 | 2.93 |
| 32 | 0.00699 | 128.00 | 0.89 |
| 33 | 0.001696 | 138.25 | 0.23 |
| 34 | 0.000349 | 148.50 | 0.05 |
| | | Total Payoffs | $1,566.24 |

This provides a revenue of $2,000.00 per 100 players, and a payoff of approximately $1567. This leaves the gaming organization with a profit greater than 20%. The average loss per player for 40 decisions is $4.33 with a negative win percentage of 2.5%. This costs the player slightly more than $.10 per decision to play the game, which is relatively small in comparison to other games while still providing an opportunity to win large jackpots. Over 56% of the players receive a prize on a consistent basis.

If the casino elects to only payoff the same amount ($1567) to players who have 22 wins or more, this would result in an average payoff of about $50 per player with 22 or more wins ($1567/31.79) for a cost of s=$20. This represents an average return for winners which is greater than a true odds payoff for having 22 wins.

The present game can be used for 2 decisions or more, if desired. For example, in a game in which 2 decisions cost $5 with a probability of the first outcome and the second outcome both equaling 0.500, the probability of obtaining zero or 2 wins would be 25% and the probability of obtaining 1 win would be 50%. Assuming 100 players play the a game at a price of s=$5, and a casino expected profit is set at 10% or $50 per 100 players, this would leave a total of $450 for payoffs. If only players with 2 wins are paid, this result in a payoff of approximately $18 for 2 wins ($450/25). The same would be true for a game in which a player can wager on no wins.

A gaming organization can also use the game to payoff for 1 or more wins. However, this would result in a lower payoff since 75% of the players would win and the $5 cost for players would only result in a payoff of $6 in order to provide the casino with a 10% profit. The same odds and payoff would also be available for one win or less.

As an additional alternative a player could receive a payoff for exactly one win, with the payoff being $9 ($450/50). The same odds and payoff would also apply to paying off for only no wins or two wins.

If only a player with 2 wins is paid off, the payoff for 2 wins is greater than the true odds payoff. However, players with only one win do not receive any return on the initial price s for playing. One advantage of the game in accordance with the present invention in which n=2 is that the game can be played with regular casino chips since it would be relatively easy to track winners who lose both decisions, win only one or win both. Those skilled in the art will understand from the present disclosure that the payoffs can be varied as desired, depending upon the amount of profit desired by the gaming organization or casino, and that the example described above is for illustrative purposes.

In games which provide a jackpot for consecutive numbers of winning and losing outcomes, the number of winning and losing outcomes are preferably tracked by placing a separator in the stack after the player fails to consecutively select a winning or losing outcome. Since the odds for selecting a consecutive number of decisions with a probability of 0.500 is the same regardless of the total number n, jackpot prizes can be offered, for example, as shown in the following table.

| | Odds Against Winning | Prize |
|---|---|---|
| 7 Consecutive Wins or Losses | 127 to 1 | $40 |
| 11 Consecutive Wins or Losses | 2,047 to 1 | $400 |
| 15 Consecutive Wins or Losses | 32,767 to 1 | $2,000 |
| 17 Consecutive Wins or Losses | 131,071 to 1 | $10,000 |
| 20 Consecutive Wins or Losses | 1,048,575 to 1 | $100,000 |

Because the probability of consecutive wins or losses can be calculated as 2 to the power of y, where y is the consecutive number of decisions, these odds would not be altered based on the number of decisions n in a game. The jackpot prize could be altered as desired. If no winners obtain the jackpot, it is also possible to lower the number of consecutive wins or losses needed to win the jackpot or to allow the number of consecutive wins or losses to include a single interruption.

Figure 4:
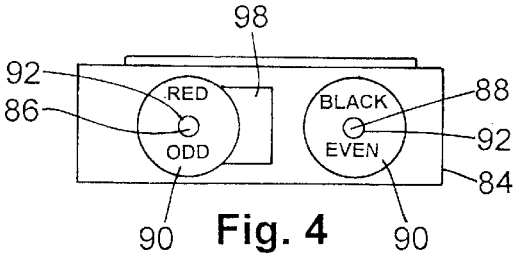
FIG. 4 is a top view of the second gaming tray device shown in FIG. 3.
Figure 3:
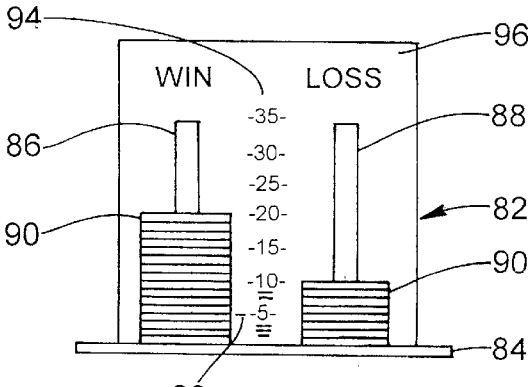
FIG. 3 is an elevational view of a second gaming tray device for tracking a correct number of decisions in the game in accordance with the present invention.

Referring now to FIGS. 3 and 4, an alternate embodiment 82 of a tracking device and markers 90 are shown. The alternative embodiment of the tracking device 82 includes a base 84 having two upstanding rods 86, 88 which are used to track wins and losses. The markers 90 used in connection with the second tracking device 82 each include an aperture 92 defined therethrough which allow the markers 90 to be stacked on the rods 86, 88 in order to track wins and losses. Preferably, a scale with numbers 94 is provided on a vertical wall 96 attached to the base 84. The scale corresponds to the stacked height of a number of markers 90. This allows for tracking of the number of wins or losses. Preferably, a separator 98 is provided which also includes an aperture defined therethrough which can be placed over either rod 86, 88 to show a consecutive number of wins or losses starting from the first decision. If desired, multiple separators 98 can be used in order to show consecutive wins or losses throughout the game. Preferably, the separator is thin enough that it does not interfere with the evaluating the number of total wins and losses.

It will be recognized by those skilled in the art that markers need not be used for a player to select one of the first and second outcomes, and verbal instructions may be given to the dealer and tracked separately, if desired.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A method of playing a game comprising:

(a) using a gaming device for generating one of a first outcome and a second outcome for gaming decisions;

(b) selling a chance to a player for a price s for playing a number of decisions n of the gaming device, where n is greater than 1;

(c) the player selecting and wagering on one of the first and second outcomes separately for each of the number of decisions n;

(d) generating a series of n decisions with the gaming device from one of the first and second outcomes;

(e) tracking a correct number of decisions m made by the player out of the number of decisions n purchased by the player; and (f) paying the player having a predetermined correct number of decisions an amount based on a binomial distribution.

2. The method of claim 1 further comprising the player receiving a marker for each of the number of decisions n, each marker includes first indicia representing the first outcome on a first side, and second indicia representing the second outcome on a second side, and wherein the player selects one of the first and second outcomes for each of the n decisions by placing one marker for each of the n decisions with the side with the indicia representing the selected outcome for each decision facing up.

3. The method of claim 2 wherein the markers have a non-negotiable wagering value, the method further comprising discounting the price of the n markers up to approximately 90% of the non-negotiable wagering value when the markers are sold to the player.

4. The method of claim 1 further comprising providing the player with a gaming tray having a storage area for holding markers, a wagering area for wagering on one of the first and second outcomes, and a tracking area for tracking wins, the method further comprising the player removing one of the markers from the storage area, placing the marker in the wagering area, and indicating the player selected outcome for each decision prior to generating one of the first and second outcomes with the gaming device.

5. The method of claim 1 wherein n=11 and s=$7 or a multiple z thereof, and wherein paying off the player is carried out as follows:

| value of m | payoff amount |
|---|---|
| 6 | $3z |
| 7 | $7z |
| 8 | $11z |
| 9 | $50z |
| 10 | $100z |
| 11 | $1000z. |

6. The method of claim 1 further comprising tracking at least one of a consecutive number of wins and a consecutive number of losses by the player, and paying the player a jackpot based on the player having at least one of a predetermined number of consecutive wins and a predetermined number of consecutive losses.

7. The method of claim 6 further comprising:

providing the player with a marker for each decision n for which the player may wager;

providing a gaming tray having a storage area for holding n markers, a wagering area for wagering on one of the first and second outcomes, and a tracking area for tracking wins;

the player removing one marker from the storage area, placing the marker in the wagering area, and indicating the player selected outcome for each decision; and wherein the number of consecutive wins is tracked by stacking the markers wagered for each winning decision in a separate stack, and placing a separator in the separate stack after the player fails to select the winning outcome.

8. The method of claim 6 further comprising:

providing the player with a marker for each decision n for which the player may wager;

providing a gaming tray having a storage area for holding n markers, a wagering area for wagering on one of the first and second outcomes, and a tracking area for tracking wins;

the player removing one marker from the storage area, placing the marker in the wagering area, and indicating the player selected outcome for each decision; and wherein the number of consecutive losses are tracked by stacking the markers wagered for each losing decision in a separate stack, and placing a separator in the separate stack after the player fails to select the losing outcome.

9. The method of claim 6 further wherein the jackpot is progressive, the method further comprising paying the progressive jackpot for at least one of consecutive win streaks and consecutive loss streaks.

10. The method of claim 6 wherein a value of the one of the predetermined number of consecutive wins and the predetermined number of consecutive losses needed to win the jackpot is initially set at n, and after an occurrence of one of a predetermined number of plays and a predetermined dollar amount of player losses without the jackpot being won, the value is reduced to n−1.

11. The method of claim 1 further comprising tracking one of a number of consecutive wins and a number of consecutive losses by the player, and paying the player a jackpot based on the player having one of a predetermined number of consecutive wins, a predetermined number of consecutive losses, a predetermined number of consecutive wins with an interruption and a predetermined number of consecutive losses with an interruption.

12. The method of claim 1 wherein the game is played concurrently with another game having an outcome generating device, and the outcome generating device for the other game is used as the gaming device, the method further comprising the player selecting one of the first and second outcomes for each decision as a side bet.

13. The method of claim 12 wherein the other game is blackjack, and at least the first and second cards dealt to the player are used as the outcome for gaming decisions, with each hand providing at least two decisions, the first and second outcomes being red or black, the method further comprising the player selecting one of red or black for each of the gaming decisions n as a side bet.

14. The method of claim 12 wherein the other game is craps, and each dice roll is used as an outcome for a gaming decision, the first and second outcomes being one of odd or even and 7 and over or 7 and under, the method further comprising the player selecting a selected one of odd or even and seven and over or seven and under for each of the gaming decisions n as a side bet.

15. The method of claim 1 wherein the player is paid if the predetermined number of correct decisions is greater than n/2.

* * * * *